United States Patent [19]

Chapnick

[11] Patent Number: 4,648,923

[45] Date of Patent: Mar. 10, 1987

[54] METHOD OF FORMING A SHOE INSERT

[76] Inventor: Bernard Chapnick, 3 Pasture Rd., Beverly, Mass. 01915

[21] Appl. No.: 697,474

[22] Filed: Feb. 1, 1985

Related U.S. Application Data

[62] Division of Ser. No. 566,186, Dec. 28, 1983, Pat. No. 4,586,273.

[51] Int. Cl.[4] ..... A43B 10/00; A43B 13/41

[52] U.S. Cl. ..... 156/82; 156/221; 156/245

[58] Field of Search ..... 36/44, 43, 76 C, 37, 36/62; 428/316.6; 128/595, 616, 685; 156/82, 221, 222, 224, 182, 245

[56] References Cited

U.S. PATENT DOCUMENTS

| | | | |
|---|---|---|---|
| 4,054,706 | 10/1977 | Shapiro | 156/82 |
| 4,187,621 | 2/1980 | Cohen | 36/44 |
| 4,338,734 | 7/1982 | Schwartz | 36/44 |
| 4,413,429 | 11/1983 | Power | 36/44 |
| 4,503,576 | 3/1985 | Brown | 36/43 |

*Primary Examiner*—Michael Ball

*Attorney, Agent, or Firm*—Wolf, Greenfield & Sacks

[57] ABSTRACT

A shoe insert for use with a shoe or sneaker to reduce impact to the foot and to absorb shock and attenuate shock to the foot. The insert is comprised of a base layer of a relatively resilient material, a foam layer disposed over the base layer, a fabric disposed over the foam layer and means integrally forming the base layer, foam layer and fabric into a sheet tri-laminate. A support layer is disposed only at the heel area and is constructed of a rigid material of higher density than that of the tri-laminate. Means are provided for attaching and forming the tri-laminate with the support layer.

6 Claims, 7 Drawing Figures

14
11
12
13
4
5
6

Fig. 4
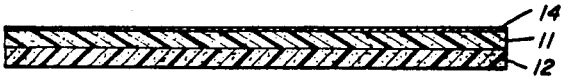
Fig. 5
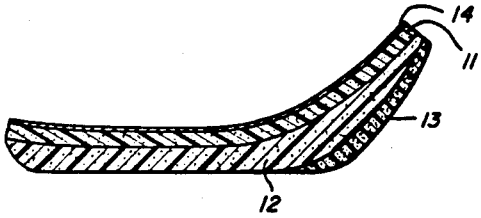
Fig. 6
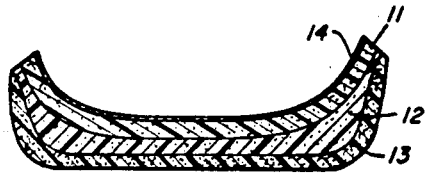
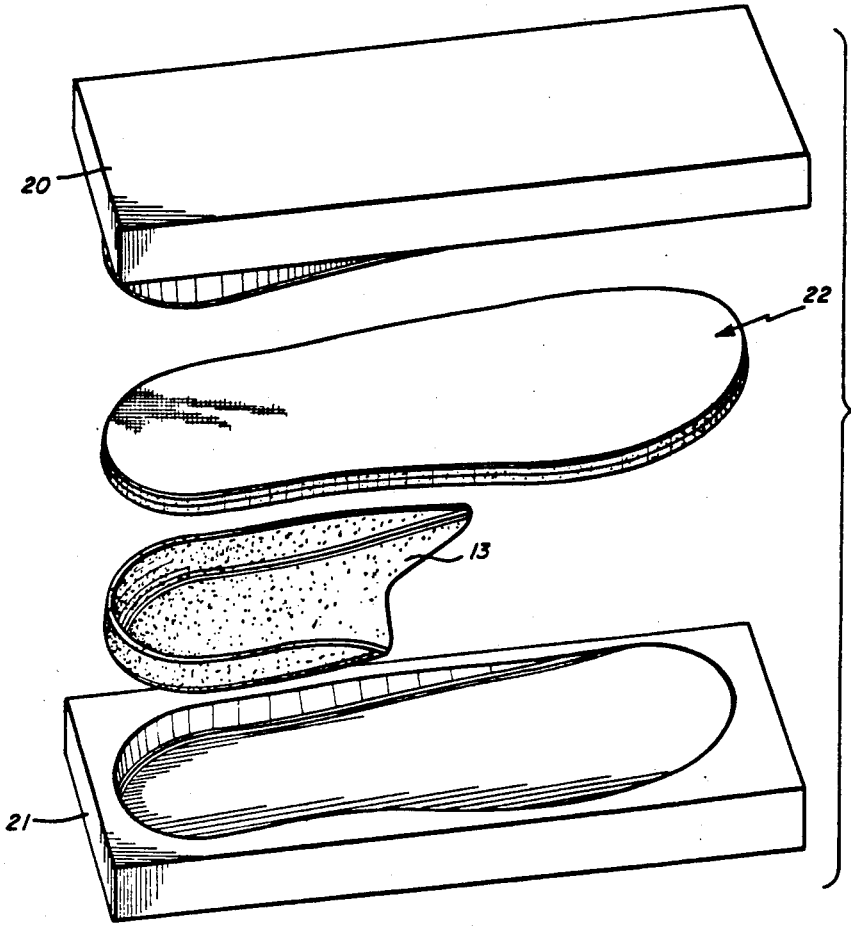
Fig. 7

METHOD OF FORMING A SHOE INSERT

This application is a division of application Ser. No. 566,186, filed Dec. 28, 1983 now U.S. Pat. No. 4,586,273.

BACKGROUND OF THE INVENTION

The present invention relates in general to a shoe insert and pertains, more particularly, to a shoe insert that is adapted to provide improved arch support, shock attenuation, and shock absorption. Also, the present invention is concerned with the associated method of manufacture of the shoe insert.

Shoe inserts that are presently in use do not adequately withstand impact, particularly as might occur when the shoe or sneaker is used in a sporting event. For example, in connection with basketball or football playing, the player may well be subjected to severe shock impact in the foot area.

Accordingly, it is an object of the present invention to provide an improved shoe insert construction that provides proper foot, and in particular, arch support.

Another object of the present invention is to provide an improved shoe insert construction that provides for substantial shock attenuation and shock absorption.

Still another object of the present invention is to provide an improved shoe insert that is lightweight, relatively simple to manufacture, relatively inexpensive in construction, and which can withstand impacts that occur particularly in connection with sporting events.

A further object of the present invention is to provide an improved shoe insert that maintains its functionality even over long periods of wear and further maintains its desired shape even after long hours of use.

SUMMARY OF THE INVENTION

To accomplish the foregoing and other objects, features and advantages of the invention, there is provided a shoe insert which is comprised of a base layer of a relatively resilient material, a foam layer disposed over the base layer, a fabric disposed over the foam layer and means for integrally forming the base layer, foam layer, and fabric into a sheet tri-laminate. A support layer is disposed at the heel area of the insert and is of a rigid material of a higher density than that of the tri-laminate. This rigid support layer is attached to and formed with the tri-laminate layer. The base layer and support layer are preferably both of a urethane foam. The fabric may be of cotton, polyester or polypropylene knit. The base layer is preferably of a cross-linked polyethylene.

The method in accordance with the invention comprises the steps of providing a foam layer, providing a fabric layer, heating the foam layer, joining the foam and fabric layers, and providing a base layer. One of the base layer and foam layer are heated so as to join the base layer with the foam layer to form a tri-laminate. There is provided a pre-formed heel member and adhesive is applied between the heel member and the tri-laminate with the adhesive being heat and pressure reactivatable. Finally, the heel member and tri-laminate are molded under pressure causing shaping thereof and formation into an integral one-piece shoe insert.

BRIEF DESCRIPTION OF THE DRAWINGS

Numerous other objects, features and advantages of the invention should now become apparent upon a reading of the following detailed description taken in conjunction with the accompanying drawing, in which:

FIG. 4 is a cross-sectional view taken along line 4—4 of FIG. 2 in the ball area of the insert;

FIG. 5 is a cross-sectional view taken along line 5—5 of FIG. 2;

FIG. 6 is a cross-sectional view taken along line 6—6 of FIG. 2 in the heel area of the insert; and FIG. 7 is a schematic perspective view illustrating one of the steps in the sequence of manufacture of the insert of the present invention.

DETAILED DESCRIPTION

Figures 1, 2, 3:
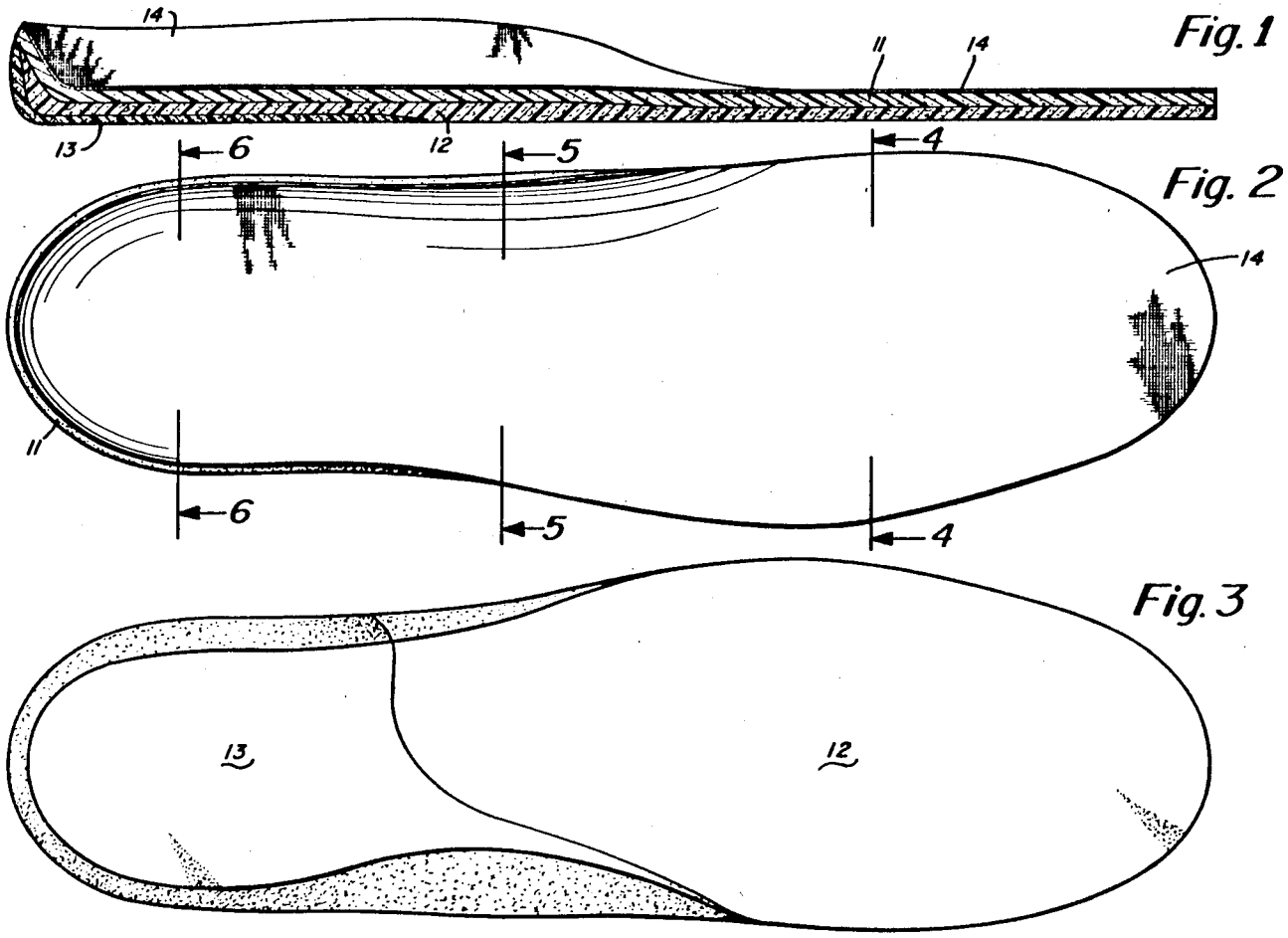
FIG. 1 is a longitudinal cross-sectional view of a shoe insert as constructed in accordance with the present invention.
FIG. 2 is a top plan view of the insert of FIG. 1.
FIG. 3 is a bottom view of the insert of FIG. 1.

FIGS. 1-6 illustrate the details of the shoe insert construction of the present invention. FIG. 7 is a schematic perspective view illustrating one of the steps in the sequence of the method of the invention. With regard to the construction of the insert, as illustrated in FIGS. 1-7, the insert comprises a base layer 12, a support layer 13, a foam layer 11, and a fabric layer 14. The layers 11, 12, and 14 are relatively resilient and conform in shape to the desired shoe size. The support layer 13 is rigid and as noted in FIG. 1 is principally at the heel area of the shoe insert.

The foam layer 11 as well as the support layer 13 is preferably constructed of a polyurethane foam material. The support layer 13 is of a denser foam thus making the support layer more rigid. The layer 11 preferably has a density of 5 lbs. per cubic ft. and it is preferred that this density be in the range of 4–6 lbs. per cubic ft. The layer 11 has a preferred thickness of $\frac{1}{8}''$+or−5% and is preferably in a range of thickness of 3/32"-5/32". The material used for layer 11 as well as layer 13 may be made by Crestfoam Company.

The layer 12 preferably also has a density in a range of 4–6 lbs. per cubic ft. The base layer 12 is preferably of cross-linked polyethylene. The thickness of the base layer 12 is preferably on the order of 5/16"+or−10%. The thickness of the base layer 12 may actually extend through a range of $\frac{1}{4}''$ to 7/16" in thickness. The material of the base layer 12 may be made by Dynamet Nobel Company.

With regard to the support layer 13, which is formed primarily at the heel area of the insert, this is also made of a polyurethane foam. However, this is made by being compressed so that the final density is on the order of 22–23 lbs. per cubic ft. The fabric layer 14 may be constructed of, for example, cotton, polyester, or a polypropylene knit.

Reference may now be made to FIG. 7 which shows one of the steps in the method of construction of the shoe insert of this invention. The shoe insert is formed by first joining the foam layer 11 with the fabric layer 14. The layers 11 and 14 are laminated together by a flame lamination technique which employs an open flame which is directed to the foam layer 11. The open flame generates sufficient heat on the surface to cause melting of the flat sheet layer 11. Once melted, the fabric layer 14 is joined therewith and the two sandwiched together layers are preferably run between chilled rollers and sufficient pressure is applied between the rollers so that the layers 11 and 14 are joined together. At this point in the process, these layers are still maintained in a flat sheet form.

The integrated layers 11 and 14 are then next joined also by flame lamination to the base layer 12. This step in the method of manufacture may also be carried out by the use of an open flame directed to either layer 11 or layer 12 to cause melting thereof. The previously integrated layers 11 and 14 are then joined to layer 12 and the laminated layers are then run betweeen chilled rollers. At this stage of the process, the layers are still in flat sheet form.

The layers thus laminated to this point are then ready for molding. This requires a neating of the laminated layers to a molding temperature of approximately 250° F. for a period of about 225 seconds. This heats the previously laminated layers sufficiently to permit them to be inserted into the mold.

Reference may now be made to FIG. 7 which shows the mold in the schematic manner as comprised of mold pieces 20 and 21. The mold may be made of aluminum. FIG. 7 also shows the tri-laminate 22 which is comprised of layers 11, 12, and 14. The tri-laminate 22 is shown as still in flat sheet form in FIG. 7 and disposed adjacent the pre-formed support layer or cup 13. Reference is made hereinafter to the manner in which the compressed foam cup 13 is formed.

The pre-formed heel layer or cup 13 is placed in the mold comprised of mold pieces 20 and 21 and an adhesive is applied to the inside of the layer 13. The tri-laminate 22 is appropriately positioned and the mold is closed. The adhesive is preferably a chlorinated rubber base adhesive which is heat and pressure reactivatable. One adhesive that is used is made by Jetco. Thus, during this molding step, it is seen that the adhesive is activated at substantially the same time that the shaping of the tri-laminate 22 along with the heel layer 13 occurs. This shaping is accomplished of course, by means of the mold press. The molding occurs under a pressure, preferably of 85 lbs. psi. The mold is illustrated in FIG. 7 in a schematic fashion and is preferably a water cooled mold. The mold may be cooled by passage of water therethrough so as to maintain the temperature at approximately 40° F. The mold is maintained in its press-mold state for approximately 50–65 seconds. Thus, the material inserted into the mold which includes the tri-laminate 22 and the layer 13, essentially is inserted into the mold in a hot condition, recalling that at least the tri-laminate 22 is heated to proper molding temperatures, and is then brought to a colder temperature by virtue of the cooling of the mold. Also, at the same time that this molding occurs, the adhesive is activated by virtue of contact with the preheated tri-laminate 22 along with the activation of the adhesive by means of the pressure applied during the molding operation.

Thus, the molding step schematically illustrated in FIG. 7 causes the simultaneous shaping of the insert. It also causes the affixing of the cup or heel layer 13 to the previously formed tri-laminate 22.

Now, with regard to the technique for forming the cup or heel 13, it is noted that previously it has been indicated that this member is constructed of a polyurethane foam that has been compressed to a density on the order of 22–23 lbs. per cubic ft. In its compressed state, the layer 13 may have a thickness of 1/16"–⅛". However, initially, before being compressed, the polyurethane has a thickness of 1.5" and is constructed of a urethane product that has characteristics of being clickable and reticulated. The urethane is preferably clickable so that when it is cut with, for example, a scissors, there will not be a pinching on the ends. The reticulated form of the urethane means that the cell membranes have been removed electrically or chemically. Ideally, the reticulation is on the order of 80–90 pores/inch, although, a preferred range is 50–90 pores/inch of reticulated foam. In this regard, the higher the cell or pore count, the more cosmetically acceptable is the material because the cells are smaller and thus have a more pleasing aesthetic appearance.

The 1.5" thick urethane is compressed by means of a steel or brass tool. The compressing tool preferably has a high heat conductivity and in this regard, brass is preferred. The tool is heated, preferably to a temperature of 450° F. and this causes the foam to be uniformly softened whereby it is caused to be compressed by the tool. Once compressed, it is set into this compressed state and it maintains the compressed state. The tool is similar in form to a mold and operates at say, 86 psi. for 90 seconds. The heat, as mentioned previously, is preferably at 450° F. It is preferred that this temperature be maintained during the compressing phase and that the heat not be allowed to drop substantially from that temperature.

Once the cup layer 13 has been preformed, then it is employed in the mold illustrated in FIG. 7 with the adhesive being coated inside of the cavitated heel layer 13.

Having now described one form of the present invention, it should now be apparent to those skilled in the art that numerous other embodiments and modifications thereof are contemplated as falling within the scope of this invention.

What is claimed is:

1. A method of making a shoe insert comprising the steps of; providing a foam layer, providing a fabric layer, heating the foam layer, joining the foam and fabric layers, providing a base layer of a density on the same order of magnitude as the density of the foam layer, heating one of said base layer and foam layer, joining the base layer with the foam layer to form a trilaminate, providing a pre-formed heel member of a density substantially greater than the density of the foam layer and formed of a compressed foam material to obtain greater density and thus greater rigidity in comparison to that of the foam layer, applying adhesive between the heel member and the trilaminate, said adhesive being heat and pressure reactivatable, and molding under pressure, said heel member and trilaminate so as to cause shaping, of the trilaminate into the heel member and forming into an integral one-piece shoe insert with the pre-formed heel member forming the bottom surface of the finished shoe insert at the heel area thereof, and the base layer forming the bottom surface of the finished shoe insert at the forward area thereof.

2. A method as set forth in claim 1 wherein the trilaminate is formed by means of flame lamination.

3. A method as set forth in claim 1 wherein the trilaminate is heated to a molding temperature prior to insertion into the mold.

4. A method as set forth in claim 3 wherein the heating to a molding temperature is at approximately 250° F. for a period of approximately 225 seconds.

5. A method as set forth in claim 1 wherein the molding step includes water cooled molding carried out at a temperature on the order of 40° F. for a period on the order of 50–65 seconds.

6. A method of making a shoe insert comprising the steps of; providing a base layer of a relatively resilient material, providing a foam layer disposed over the base layer, providing a fabric disposed over the foam layer, forming a trilaminate by integrally forming with application of heat the base layer, foam layer and fabric, providing a pre-formed heel member of a density substantially greater than the density of the foam layer and formed of a compressed foam material to obtain greater density and thus greater rigidity in comparison to that of the foam layer, forming said base and foam layers of comparable thickness and each substantially thicker than the fabric layer, forming the base layer and foam layer with densities on the same order of magnitude, applying adhesive between the heel member and the trilaminate, said adhesive being heat and pressure reactivatable, and molding under pressure said heel member and trilaminate so as to cause shaping of the trilaminate into said into conformal shape with the heel member.

* * * * *